US010287890B2

(12) United States Patent
Andreou et al.

(10) Patent No.: US 10,287,890 B2
(45) Date of Patent: May 14, 2019

(54) ABRASIVE PROCESSING METHOD

(71) Applicant: ROLLS-ROYCE PLC, London (GB)

(72) Inventors: Richard Andreou, Nottingham (GB); Wee Kin Teo, Singapore (SG); Arthur Wee, Singapore (SG)

(73) Assignee: ROLLS-ROYCE plc, London (GB)

( * ) Notice: Subject to any disclaimer, the term of this patent is extended or adjusted under 35 U.S.C. 154(b) by 566 days.

(21) Appl. No.: 14/851,903

(22) Filed: Sep. 11, 2015

(65) Prior Publication Data

US 2016/0102559 A1 Apr. 14, 2016

(30) Foreign Application Priority Data

Oct. 9, 2014 (GB) ..... 1417861.0

(51) Int. Cl.
*B24B 1/00* (2006.01)
*B24B 19/14* (2006.01)
(Continued)

(52) U.S. Cl.
CPC ..... *F01D 5/147* (2013.01); *B24B 1/00* (2013.01); *B24B 19/14* (2013.01); *B24B 21/16* (2013.01);
(Continued)

(58) Field of Classification Search
CPC B24B 1/00; B24B 19/14; B24B 21/16; B24B 21/165; B24B 49/16; B24B 49/183; F01D 5/147; F01D 2230/10
(Continued)

(56) References Cited

U.S. PATENT DOCUMENTS 1,849,925 A * 3/1932 Heuze ..... B24B 7/24 451/259
3,524,285 A * 8/1970 Rutt ..... B23Q 15/12 451/24
(Continued)

FOREIGN PATENT DOCUMENTS

EP 0444657 A1 9/1991
EP 0627283 A1 12/1994
(Continued)

OTHER PUBLICATIONS

Mar. 16, 2015 Search Report in Great Britian European Patent Application No. GB1417861.0.
(Continued)

*Primary Examiner* — Eileen P Morgan
(74) *Attorney, Agent, or Firm* — Oliff PLC

(57) ABSTRACT

The present invention provides an apparatus and method for processing a component surface by abrading the component surface using an abrasive surface. The apparatus comprises an abrasive surface which is rotatable about an axis extending parallel to said component surface. A support is provided for moving the abrasive surface or the component surface along a computer-generated toolpath and for applying a force between the abrasive surface and the component surface. The support increases the force between the abrasive surface and the component surface from a minimum force to a maximum force as the distance along the toolpath increases to maintain constant material removal from the component surface.

18 Claims, 1 Drawing Sheet

(51) Int. Cl.

| | |
|---|---|
| ***B24B 21/16*** | (2006.01) |
| ***B24B 49/16*** | (2006.01) |
| ***F01D 5/14*** | (2006.01) |
| ***B24B 49/18*** | (2006.01) |
| ***F01D 9/04*** | (2006.01) |

(52) U.S. Cl.
CPC ..... *B24B 21/165* (2013.01); *B24B 49/16* (2013.01); *B24B 49/183* (2013.01); *F01D 9/041* (2013.01); *F01D 5/141* (2013.01); *F05D 2220/32* (2013.01); *F05D 2230/10* (2013.01); *F05D 2230/90* (2013.01)

(58) Field of Classification Search
USPC ..... 451/5, 10, 11, 21
See application file for complete search history.

(56) References Cited

U.S. PATENT DOCUMENTS

| | | | | | |
|---|---|---|---|---|---|
| 3,736,704 | A * | 6/1973 | Robillard | B23Q 15/10 | 451/12 |
| 3,811,228 | A * | 5/1974 | Nagashima | B23Q 15/00 | 451/142 |
| 3,913,277 | A * | 10/1975 | Hahn | B23Q 15/12 | 451/21 |
| 4,514,937 | A * | 5/1985 | Gehrung | B24B 7/13 | 451/163 |
| 2002/0019195 | A1* | 2/2002 | Asano | B23F 19/007 | 451/8 |
| 2010/0311309 | A1* | 12/2010 | Shinozaki | B24B 49/08 | 451/5 |
| 2012/0124834 | A1 | 5/2012 | Cholet et al. | | |
| 2012/0220194 | A1 | 8/2012 | Maloney et al. | | |
| 2013/0122783 | A1* | 5/2013 | Menk | B24B 37/042 | 451/11 |

FOREIGN PATENT DOCUMENTS

| | | | | |
|---|---|---|---|---|
| EP | 2050536 | A1 | 4/2009 | |
| EP | 2204535 | A2 | 7/2010 | |
| JP | 2009-226562 | A | 10/2009 | |
| SU | 1076267 | * | 2/1984 | B24B 37/00 |
| WO | 92/10796 | A1 | 6/1992 | |

OTHER PUBLICATIONS

Mar. 2, 2016 Search Report issued in European Patent Application No. 15184835.

* cited by examiner

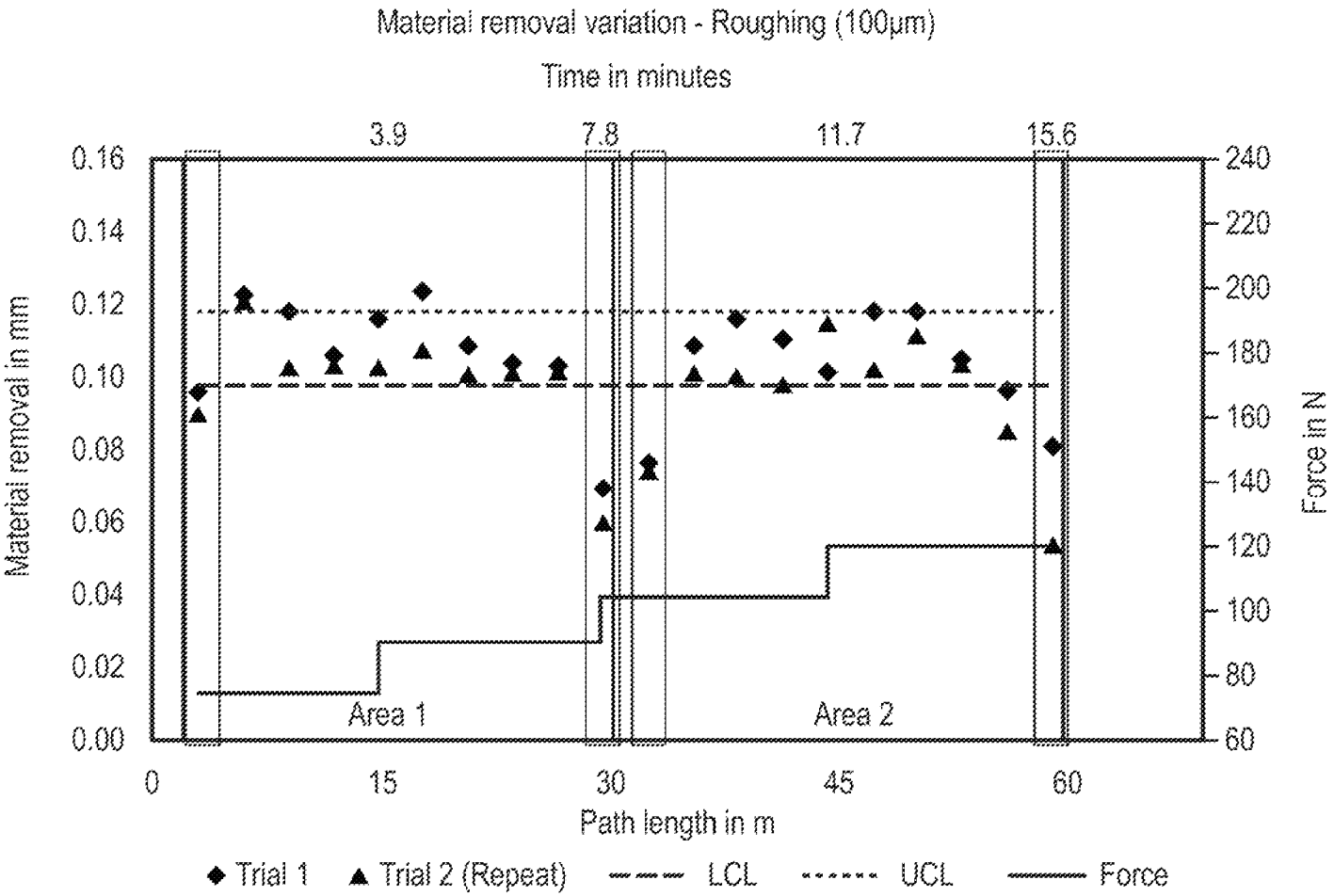
Material removal variation - Roughing (100µm)
Time in minutes
3.9
7.8
11.7
15.6
Area 1
Area 2
Path length in m
0
15
30
45
60
Material removal in mm
0.16
0.14
0.12
0.10
0.08
0.06
0.04
0.02
0.00
Force in N
240
220
200
180
160
140
120
100
80
60
Trial 1
Trial 2 (Repeat)
LCL
UCL
Force

ABRASIVE PROCESSING METHOD

FIELD OF THE INVENTION

The present invention relates to a method of processing a component such as an aerofoil for a gas turbine engine. In particular, the present invention relates to a method of processing the surface of a component by abrading the surface.

BACKGROUND OF THE INVENTION

It is known to process the surface of a component such as an aerofoil (e.g. a blade or vane) for a gas turbine engine by polishing or linishing to remove small amounts of material in order to obtain the required surface profile and/or finish. This is typically carried out using a belt having an abrasive surface that is rotated on a wheel about an axis that extends parallel to the component surface whilst the abrasive surface is moved over and against the component surface along a continuous toolpath at a constant pressure. The granular nature of the abrasive surface removes surface irregularities on the component surface as the abrasive surface moves over and against the component surface.

Prolonged use of the abrasive belt gradually reduces the granular nature of the abrasive surface such that the effectiveness of the abrasive surface is gradually reduced. This means that areas of the component surface that are processed during the early stages of the continuous toolpath of the abrasive surface are much more effectively processed (i.e. the desired level of material removal is achieved) than the areas of the component surface that are processed during the later stages of the continuous toolpath of the abrasive surface (where a lower level of material removal is achieved). This can lead to an inconsistent surface profile/finish across the component surface.

Replacing the abrasive surface as soon as its effectiveness is sub-optimal can significantly increase the processing cost.

There is the need for a processing method that allows accurate control of the amount of material removal across an entire component surface even when the abrasive nature of the abrasive surface is sub-optimal.

SUMMARY OF THE INVENTION

In a first aspect, the present invention provides a method of processing a component surface by abrading the component surface using an abrasive surface, said method comprising:

- rotating said abrasive surface about an axis extending parallel to said component surface; and
- moving said abrasive surface or said component surface along a computer-generated toolpath whilst applying a force between the abrasive surface and the component surface,
- wherein the force between the abrasive surface and the component surface is increased from a minimum force to a maximum force as the distance along the toolpath increases.

By increasing the force between the abrasive surface and the component surface as the progress along the toolpath increases, the decrease in the granular nature of the abrasive surface caused by wear is compensated for by the increase in force between the abrasive surface and the component surface thus ensuring that the abrasive surface is capable of constant material removal across the entirety of the component surface. This then allows accurate control of material removal across the component surface.

Optional features of the invention will now be set out. These are applicable singly or in any combination with any aspect of the invention.

In some embodiments, the force between the abrasive surface and the component surface is increased linearly (at a constant rate) from the minimum force to the maximum force as the distance along the toolpath increases.

In some embodiments, the force between the abrasive surface and the component surface is increased in a stepwise manner from the minimum force to the maximum force as the distance along the continuous toolpath increases.

In some embodiments, the step of moving the abrasive surface or the component surface is carried out automatically either by moving the abrasive surface or by moving the component using a support e.g. computer-controlled robotic arm.

In some embodiments, the method comprises applying a force urging the abrasive surface towards the component surface or urging the component surface towards the abrasive surface.

The support may also be adapted to apply the force urging the abrasive surface towards the component surface or the component surface urged towards the abrasive surface.

In some embodiments, the force between the abrasive surface and the component surface is controlled by a pneumatic, hydraulic, mechanical or electrical compliance force system such as that provided by PushCorp, Inc.

In some embodiments, the method further comprises modifying the feed rate (i.e. the rate at which the abrasive surface is moved relative to the component surface or the component surface is moved relative to the abrasive surface) to control the amount of material removed from the component surface. By increasing the force between the abrasive surface and the component surface along the toolpath, constant material removal is possible even as the belt wears. In some instances, constant material removal is not required i.e. some areas of the component surface may require less or greater amounts of stock removal. The amount of stock removal can be accurately controlled by varying the feed rate (which is inversely proportional to the amount of stock removal).

In some embodiments, the abrasive surface is provided on a belt and the method comprises rotating the belt on a wheel around an axis parallel to the surface of the component.

In some embodiments, the component surface is a surface of an aerofoil for a gas turbine engine.

The computer-generated toolpath may include, for example, a series of linear, parallel paths with the abrasive surface/component surface passing along adjacent parallel paths either in the same direction or in opposite directions.

In some embodiments, the method further comprises a first calibration step comprising establishing the minimum force by moving the abrasive surface relative to the surface of a plate formed of a material substantially identical to the component surface whilst urging the abrasive surface towards the plate surface using a first force and measuring the amount of material removed, if necessary, adjusting the first force until the amount of material removed falls within a desired range and using the first force or adjusted first force as the minimum force. During this step, the speed of rotation of the abrasive surface about the axis extending parallel to the plate surface will be kept constant.

In some embodiments, the method comprises a second calibration step comprising processing the plate surface by moving the abrasive surface relative to the plate surface along a toolpath whilst urging the abrasive surface towards the plate surface using the minimum force, detecting when the amount of material removal drops below the desired range and increasing the force by an amount necessary to increase the material removal to within the desired range, repeating the detecting and increasing steps until the tool path is complete and selecting the force in use at the end of the toolpath as the maximum force. During this step, the speed of rotation of the abrasive surface about the axis extending parallel to the plate surface will be kept constant.

The values of the minimum and maximum forces can then be used during processing of the component e.g. during processing of the component, the force urging the abrasive surface against the component surface can be linearly increased at a constant rate from the experimentally determined minimum force to the experimentally determined maximum force.

In a second aspect, the present invention provides an apparatus for processing a component surface by abrading the component surface using an abrasive surface, said apparatus comprising:

an abrasive surface, said surface being rotatable about an axis extending parallel to said component surface; and a support for moving said abrasive surface or said component surface along a computer-generated toolpath and for applying a force between said abrasive surface and said component surface, wherein the support is adapted to increase the force between the abrasive surface and the component surface from a minimum force to a maximum force as the distance along the toolpath increases.

In some embodiments, the support is adapted to linearly increase the force between the abrasive surface and the component surface (at a constant rate) from the minimum force to the maximum force as the distance along the toolpath increases.

In some embodiments, the support is adapted to increase the force between the abrasive surface and the component surface in a step-wise manner from the minimum force to the maximum force as the distance along the continuous toolpath increases.

The support may be adapted for supporting and moving the abrasive surface along the computer-generated tool-path. The support may be adapted for urging the abrasive surface towards the component surface.

The support may be adapted for supporting and moving the component surface along the computer-generated toolpath. The support may be adapted for urging the component surface towards the abrasive surface.

In some embodiments, the support comprises a computer-controlled robotic arm. In some embodiments, the apparatus further comprises a pneumatic, hydraulic, mechanical or electrical compliance force system (such as that provided by PushCorp, Inc.) for controlling the force between the abrasive surface and the component surface.

In some embodiments, the apparatus further comprises a controller for modifying the feed rate (i.e. the rate at which the abrasive surface is moved relative to the component surface or the component surface is moved relative to the abrasive surface) to control the amount of material removed from the component surface.

In some embodiments, the abrasive surface is provided on a belt. The belt may be mounted on a tool having at least one wheel. The tool may be provided on the support (e.g. on the robotic arm) or on a fixed mount e.g. the tool may be floor mounted.

In some embodiments, the component surface is a surface of an aerofoil, e.g. a blade or vane, for a gas turbine engine.

In a third aspect, the present invention provides an aerofoil for a gas turbine engine having a surface processed using the method and the apparatus of the first and second aspects.

In a fourth aspect, the present invention provides a gas turbine engine having an aerofoil according to the third aspect.

BRIEF DESCRIPTION OF THE DRAWINGS

Embodiments of the invention will now be described by way of example with reference to the accompanying drawings in which:

FIG. 1 shows a graph of material removal against toolpath length, processing time and force.

DETAILED DESCRIPTION AND FURTHER OPTIONAL FEATURES OF THE INVENTION

FIG. 1 shows a graph of material removal (in mm) against toolpath length (in m), processing time (in minutes) and force (in N) for a VSM XK760X p80 belt (3500 mm long and 25 mm wide) running at a belt speed of 8.67 m/s.

In order to establish an appropriate force profile for the desired material removal (in this case between 0.1 and 0.12 mm), a flat plate formed of an identical material to the component surface was prepared.

The VSM belt having an abrasive surface was mounted on a force compliance control system (provided by PushCorp, Inc.) on a robotic arm and the abrasive surface was moved against the plate at a constant belt speed (8.67 m/s) and constant feed rate (64 mm/s). The amount of material removed was observed using an ultrasonic probe (although GOM or CMM could also be used). The force between the abrasive surface and plate was noted.

If the material removal was too great, the process was repeated at a lower force. If the material removal was too little, the process was repeated at a higher force. In this way, an initial force of 75 N was determined as this gave the desired material removal.

Next, the plate was processed with the abrasive surface moving along a toolpath and the amount of material removal was determined along the toolpath. When the amount of material removal dropped below the desired range, the amount of force applied by the robotic arm was increased by an amount sufficient to increase the amount of material removal to back within the desired range. In this case, it was found that an increase of 15 N was needed after just under 4 minutes of processing time (or after a toolpath length of just under 15 m).

This process was carried out along the entire length of the toolpath (60 m in this case) and it was established that an increase of 15 N was needed at equally spaced intervals (just under 4 minutes processing time and just under 15 m of toolpath length).

After a processing time of 15.6 minutes and a toolpath length of 60 m, the force was increased to 120 N.

This information was used to calculate a linear profile for the force increase as follows:

Total distance traveled by belt=belt speed (m/s)×time (s)=8115.12 m

Total force increase=Maximum force−minimum force=45 N

Change in force=45/8115.12=0.0055 N per every meter of belt contact

This linear force profile was then used to process a component using the VSM belt at a belt speed of 8.67 m/s. The feed rate i.e. the speed at which the abrasive surface of the belt was moved over the component surface was varied throughout processing to take account of the material removal requirements. When an increase in material removal was required, the feed rate was reduced and when a decrease in material removal was required, the feed rate was increased.

As shown above, using the linear force profile experimentally determined for the VSM belt at a feed rate of 64 mm gave a constant material removal of 0.1-0.12 mm. To double the material removal to 0.2-0.24, the feed rate would be reduced to 32 mm/s. To half the material removal to 0.05-0.06, the feed rate would be increased to 128 mm/s.

Accordingly, the force between the abrasive surface and the component surface can be controlled to result in constant material removal rate and the feed rate can be controlled to control the amount of stock removed over the component surface.

To take account of the fact that the force profile is calculated using a flat plate and the component surface is typically contoured, a nominal liner force profile is calculated for a flat plate and this is then applied to the contoured component surface. The material removal achieved with this nominal profile is observed and the gradient of the force profile is adjusted to take into account the observed material removal. For example, the minimum force may be increased and the maximum force decreased to decrease the gradient of the linear force profile.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A method of processing a component surface by abrading the component surface using an abrasive surface, said method comprising:

rotating said abrasive surface about an axis extending parallel to said component surface;

moving said abrasive surface or said component surface along a computer generated toolpath whilst applying a force between said abrasive surface and said component surface; and modifying a feed rate of the component surface relative to the abrasive surface to control the amount of material removed from the component surface, wherein the force between the abrasive surface and the component surface is increased from a minimum force to a maximum force as the distance along the toolpath increases.

2. The method according to claim 1, wherein the force between the abrasive surface and the component surface is increased linearly from the minimum force to the maximum force as the distance along the toolpath increases.

3. The method according to claim 1, further comprising moving the abrasive surface or the component surface automatically by moving the abrasive surface or the component surface using a computer-controlled robotic arm.

4. The method according to claim 1, further comprising controlling the force between the abrasive surface and the component surface by a pneumatic, hydraulic, mechanical or electrical compliance force system.

5. The method according to claim 1, further comprising a first calibration step comprising establishing the minimum force by moving the abrasive surface relative to the surface of a plate formed of a material substantially identical to the component surface whilst urging the abrasive surface towards the plate surface using a first force and measuring the amount of material removed, if necessary, adjusting the first force until the amount of material removed falls within a desired range and using the first force or adjusted first force as the minimum force.

6. The method according to claim 5, further comprising a second calibration step comprising processing the plate surface by moving the abrasive surface relative to the plate surface along a toolpath whilst urging the abrasive surface towards the plate surface using the minimum force, detecting when the amount of material removal drops below the desired range and increasing the force by an amount necessary to increase the material removal to within the desired range, repeating the detecting and increasing steps until the tool path is complete and selecting the force in use at the end of the toolpath as the maximum force.

7. The method according to claim 1, wherein the abrasive surface is provided on a belt.

8. The method according to claim 1, wherein the component surface is a surface of an aerofoil for a gas turbine engine.

9. The method according to claim 1, wherein the component surface is a surface of an aerofoil for a gas turbine engine.

10. An apparatus for processing a component surface by abrading the component surface using an abrasive surface, said apparatus comprising:

an abrasive surface, said surface being rotatable about an axis extending parallel to said component surface;

a support for moving said abrasive surface or said component surface along a computer generated toolpath whilst applying a force between said abrasive surface and said component surface; and a controller for modifying a feed rate of the component surface relative to the abrasive surface to control the amount of material removed from the component surface, wherein said support is adapted to increase the force between the abrasive surface and the component surface from a minimum force to a maximum force as the distance along the toolpath increases.

11. The apparatus according to claim 10, wherein the support is a robotic arm.

12. The apparatus according to claim 10, wherein the support is adapted to linearly increase the force between the abrasive surface and the component surface from the minimum force to the maximum force as the distance along the toolpath increases.

13. The apparatus according to claim 10, wherein the abrasive surface is provided on a belt.

14. The apparatus according to claim 10, wherein the component surface is a surface of an aerofoil for a gas turbine engine.

15. A method of processing a component surface by abrading the component surface using an abrasive surface, said method comprising:

rotating said abrasive surface about an axis extending parallel to said component surface; and moving said abrasive surface or said component surface along a computer generated toolpath whilst applying a force between said abrasive surface and said component surface, wherein the force between the abrasive surface and the component surface is increased linearly at a constant slope over an entire length of the toolpath from a minimum force at a first end of the toolpath to a maximum force at a second end of the toolpath.

16. The method according to claim 15, wherein the component surface is a surface of an aerofoil for a gas turbine engine.

17. An apparatus for processing a component surface by abrading the component surface using an abrasive surface, said apparatus comprising:

an abrasive surface, said surface being rotatable about an axis extending parallel to said component surface; and a support for moving said abrasive surface or said component surface along a computer generated toolpath whilst applying a force between said abrasive surface and said component surface, wherein said support is adapted to linearly increase the force between the abrasive surface and the component surface at a constant slope over an entire length of the toolpath from a minimum force at a first end of the toolpath to a maximum force at a second end of the toolpath.

18. The apparatus according to claim 17, wherein the component surface is a surface of an aerofoil for a gas turbine engine.

* * * * *